United States Patent [19]

Peterman et al.

[11] Patent Number: 5,006,207

[45] Date of Patent: Apr. 9, 1991

[54] METHOD OF DECORATING AN EXPANSIVE SURFACE OF A METALLIC FAUCET SPOUT OR OTHER PLUMBING FIXTURE

[75] Inventors: Eric C. Peterman, Elm Grove; John S. Lindstedt, Hartland, both of Wis.

[73] Assignee: Gerber Plumbing Fixtures Corp., Chicago, Ill.

[21] Appl. No.: 386,292

[22] Filed: Jul. 27, 1989

[51] Int. Cl.[5] ..... C25D 5/02

[52] U.S. Cl. ..... 204/18.1

[58] Field of Search ..... 204/18.1

[56] References Cited

U.S. PATENT DOCUMENTS

| | | | |
|---|---|---|---|
| 1,783,663 | 12/1930 | McFarland | 204/18.1 |
| 2,086,069 | 7/1937 | Digby | 204/18.1 |
| 2,324,106 | 7/1943 | Petit | 204/18.1 |
| 3,545,996 | 12/1970 | Duncan | 427/198 |
| 4,133,919 | 1/1979 | Parsons | 427/259 |
| 4,285,783 | 8/1981 | Giza et al. | 204/37.6 |
| 4,400,252 | 8/1983 | Ushijima | 204/181.1 |
| 4,430,416 | 2/1984 | Goto et al. | 430/263 |
| 4,445,982 | 5/1984 | Royer | 204/18.1 |
| 4,801,490 | 1/1989 | Schuette | 428/211 |

*Primary Examiner*—T. M. Tufariello

*Attorney, Agent, or Firm*—Dressler, Goldsmith, Shore, Sutker & Milnamow, Ltd.

[57] ABSTRACT

An ornamental design is defined sharply on an expansive surface of a faucet spout by providing an initial finish on the expansive surface, the initial finish contrasting in color with what is beneath the initial finish, causing a mask to adhere to selected portions of the expansive surface, by means of a pressure-sensitive adhesive, and treating unmasked portions of the expansive surface so as to cause the unmasked portions to contrast in color with the initial finish when the mask is removed. Treating includes etching the unmasked portions, blasting the unmasked portions with a liquid jet, blasting the unmasked portions with abrasive particles in a gas stream, or blasting the unmasked portions with abrasive particles in a liquid stream. Thus, an ultimate plating layer can be so removed from the unmasked portions, so as to expose a penultimate plating layer contrasting in color with the ultimate plating layer. Providing the initial finish may include electoplating the expansive surface and/or coating the expansive surface with a colored epoxy material.

10 Claims, 1 Drawing Sheet

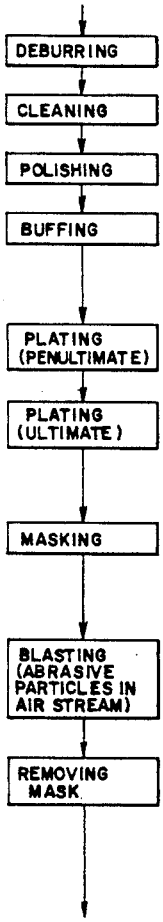

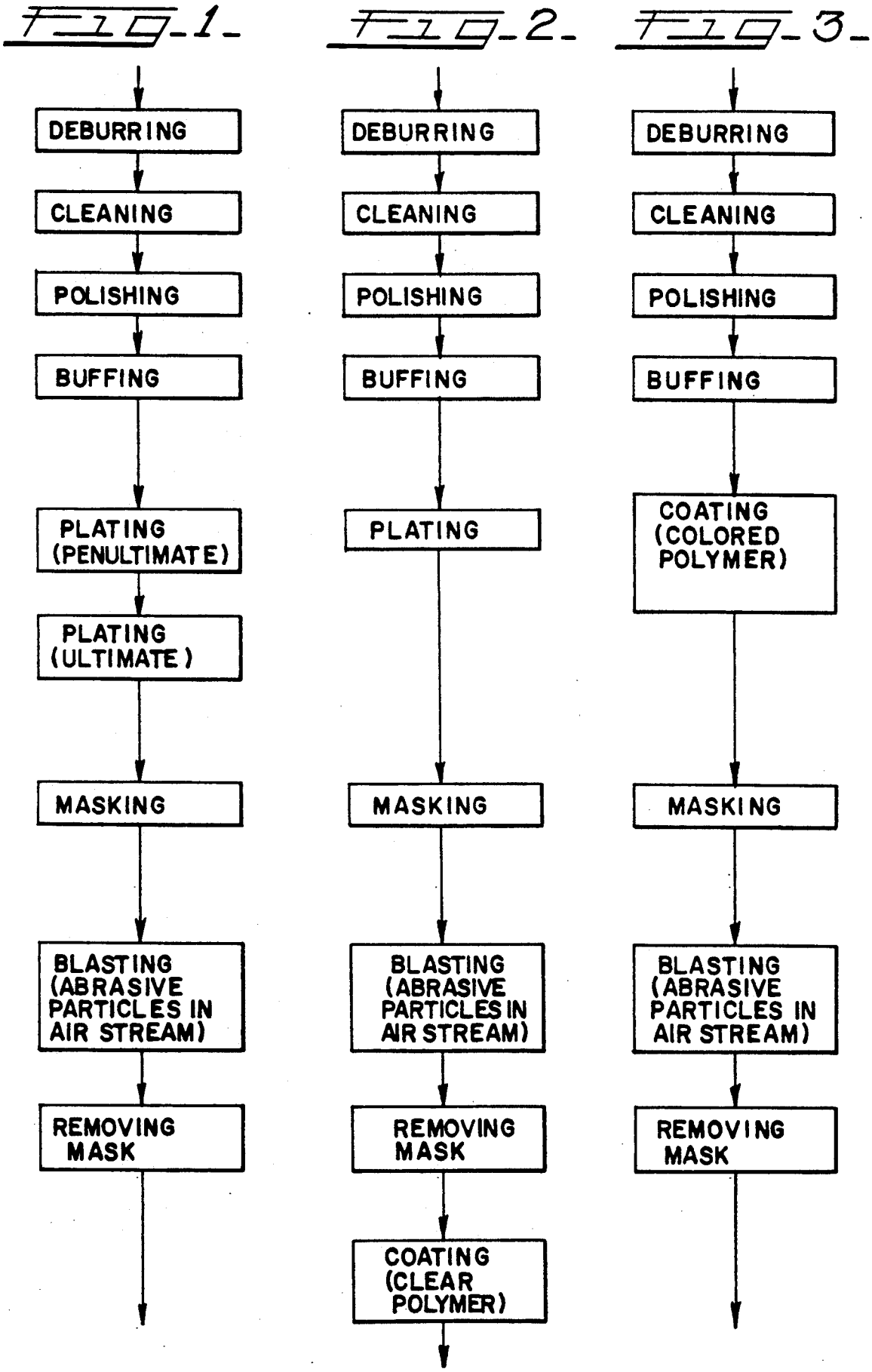
FIG. 1
DEBURRING
CLEANING
POLISHING
BUFFING
PLATING (PENULTIMATE)
PLATING (ULTIMATE)
MASKING
BLASTING (ABRASIVE PARTICLES IN AIR STREAM)
REMOVING MASK
FIG. 2
DEBURRING
CLEANING
POLISHING
BUFFING
PLATING
MASKING
BLASTING (ABRASIVE PARTICLES IN AIR STREAM)
REMOVING MASK
COATING (CLEAR POLYMER)
FIG. 3
DEBURRING
CLEANING
POLISHING
BUFFING
COATING (COLORED POLYMER)
MASKING
BLASTING (ABRASIVE PARTICLES IN AIR STREAM)
REMOVING MASK

METHOD OF DECORATING AN EXPANSIVE SURFACE OF A METALLIC FAUCET SPOUT OR OTHER PLUMBING FIXTURE

TECHNICAL FIELD OF THE INVENTION

This invention pertains to a method of decorating an expansive surface of a zinc, brass, or stainless steel faucet spout or other plumbing fixture, by providing a sharply defined, ornamental design on the expansive surface. The ornamental design is defined sharply by color-contrasted portions of the expansive surface.

BACKGROUND OF THE INVENTION

Typically, faucet spouts and other plumbing fixtures are made from zinc, brass, or stainless steel castings or stampings, the outer surfaces of which are deburred, cleaned, polished, and buffed, and which may be then provided with decorative finishes.

Commonly, such fixtures made from zinc die castings are provided with decorative finishes by being electroplated with successive copper, nickel, and chromium layers. Commonly, such fixtures made from brass castings are provided with decorative finishes by being electroplated with nickel/chromium, brass with a clear coat or gold alloys, which have been found to be more durable than exposed brass. Alternatively, such fixtures made from such castings or stampings are coated with a polymeric material, such as an epoxy, which may be electrostatically applied, as a powder, and thermoset after it has been applied, and which may be clear, white, black, or otherwise colored.

Where such a polymeric material is not applied, it is known to provide such a fixture with relatively smooth, overall surfaces and with relatively rough, overall surfaces, by protecting the blasting the overall surfaces to be relatively rough, as with abrasive particles in an air stream.

Where such a polymeric material is not applied, it also is known to place a stencil against a given surface of such a plumbing fixture, without causing the stencil to adhere to such surface, and to blast the stencil, as with abrasive particles in an air stream, so as to inscribe a manufacturer's logo on such surface.

Where such a polymeric material is applied, which is white, black, or otherwise colored, it is known to mask edge portions of such a plumbing fixture, as with masks adhering removably to such portions, while applying the polymeric material, so as to produce visual contrast between the coated and uncoated portions of the fixture.

Although faucet spouts and other plumbing fixtures can be beautifully decorated by known methods including those methods described above, it is submitted that those methods cannot be effectively used for providing a sharply defined, ornamental design on an expansive surface of such a plumbing fixture, wherein the ornamental design is defined sharply by color-contrasted portions of the expansive surface.

It should be here noted that most if not all metals and metal alloys are various shades of red, gray, or yellow. Thus, copper is red, whereas zinc, silver, nickel, chromium, and aluminum are various shades of gray, and whereas brass and gold alloys are various shades of yellow. Any of a palette of colors are obtainable with polymeric coating materials.

SUMMARY OF THE INVENTION

This invention provides a method of providing a sharply defined, ornamental design on an expansive surface of a zinc, brass, or stainless steel faucet spout or other plumbing fixture, wherein the ornamental design is defined sharply by color-contrasted portions of the expansive surface.

An initial finish is provided on the expansive surface, such as the surface of a casting or stamping. The initial finish must contrast in color with what is beneath the initial finish. Preferably, the initial finish is provided by deburring, cleaning, polishing, buffing, and electroplating the expansive surfaces, which may be electroplated with one, two, or more layers. Cleaning includes degreasing and removal of debris. If the expansive surface is electroplated with a single layer, the single layer must contrast in color with the casting itself. If the expansive surface is electroplated with two or more layers, the ultimate layer must contrast in color with the penultimate layer.

A clear, white, black, or otherwise colored, thermoset, polymeric material, such as an epoxy, may be alternatively or additionally applied, which provides the initial finish. The polymeric material, which can be electrostatically applied before it is thermoset, must contrast in color with the plated or unplated surface beneath such material.

A mask is caused to adhere removably to selected portions of the expansive surface, leaving such surface with unmasked portions where the mask does not adhere to such surface. The mask may comprise a single piece, or plural pieces, and may comprise a stencil. Other surfaces of the metal article may be completely masked by the same mask or by other removable masks.

Although adhesive tape, such as electrical tape, may suffice to make masks for small sample or experimental runs, masks that have been die-cut from hard natural or synthetic rubber are preferred, synthetic rubber being most preferred. An adhesive, preferably a pressure-sensitive adhesive is used to cause the mask to adhere to selected portions of the expansive surface. Because the ornamental design is to be sharply defined, it does not suffice for the mask to be merely placed against the expansive surface.

The unmasked portions of the expansive surface are treated so as to remove all of the initial finish from the unmasked portions, thereby to cause the unmasked portions to contrast in color with the initial finish when the mask is removed. Thus, when the mask is removed, an ornamental design is defined sharply by color-contrasted portions of the expansive surface. Removal of the mask contemplates removal of all traces of its adhesive surface.

The unmasked portion may be thus treated in any of various ways. Preferably, the unmasked portions are blasted with abrasive particles in an air stream, as in a blasting cabinet, so as to remove all of the initial finish from the unmasked portions, and so as to cause the unmasked portions to have a roughened finish compared to the initial finish.

Instead, the unmasked portions may be thus treated by brushing the unmasked portions, as with a brush having abrasive particles adhering to its bristles, or by blasting the unmasked portions with a liquid jet, such as a water jet, with abrasive particles in a gas stream, other than an air stream, or with abrasive particles in a liquid stream, such as a water stream, so as to remove all of the initial finish from the unmasked portions, and so as to cause the unmasked portions to have a roughened finish compared to the initial finish. Alternatively, therefore, the unmasked portions may be thus treated by etching the unmasked portions, as with a chemical agent, so as to remove all of the initial finish from the unmasked portions, and so as to cause the unmasked portions to have a roughened finish compared to the initial finish. Etching is not preferred because etching is difficult to control.

If the expansive surface has been electroplated with at least one plating layer contrasting in color with what is beneath such layer, the unmasked portions are treated, as mentioned above, so as to remove all of such layer from the unmasked portions, thereby to expose what is beneath such layer on the unmasked portions. If the expansive surface has been electroplated with at least two plating layers, which include a penultimate plating layer and an ultimate plating layer contrasting in color with the penultimate plating layer, the unmasked portions are treated so as to remove all the the ultimate plating layer from the unmasked portions of the expansive surface, thereby to expose the penultimate plating layer on the unmasked portions of the expansive surface.

These and other objects, features, and advantages of this invention are evident from the following description of several preferred embodiments of this invention.

BRIEF DESCRIPTION OF THE DRAWING

FIG. 1 is a flow chart diagramming steps employed in making a first embodiment of this invention.

FIG. 2 is a flow chart diagramming steps employed in making a second embodiment of this invention.

FIG. 3 is a flow chart diagramming steps employed in making a third embodiment of this invention.

DETAILED DESCRIPTION OF PREFERRED EMBODIMENTS

The flow charts in FIGS. 1, 2, and 3 diagram alternative modes for carrying out this invention. As mentioned above, this invention provides a method of providing a sharply defined, ornamental design on an expansive surface of a zinc, brass, or stainless steel faucet spout or other plumbing fixture, such as a cast or stamped spout or fixture, wherein the design is defined by color-contrasted portions of the expansive surface.

As shown in FIGS. 1, 2, and 3, preparatory steps of deburring, cleaning, polishing, and buffing the expansive surface are followed immediately by one or more plating and/or coating steps, which precede a masking step, and in which the expansive surface is electroplated with two or more layers including a penultimate plating layer and an ultimate plating layer contrasting in color with the penultimate plating layer, electroplated with a single plating layer contrasting in color with the expansive surface of the casting itself, or coated with a colored polymeric material, such as an epoxy. Such a coating step may follow one or more such plating steps or may occur without any such plating steps.

In the masking step, which follows the plating and/or coating steps mentioned above, a mask is caused to adhere to selected portions of the expansive surface, leaving unmasked portions where the mask does not adhere to the expansive surface. The masking step is followed by a treating step, preferably blasting the unmasked portions with abrasive particles in an air stream or alternatively blasting the unmasked portions with abrasive particles in a gaseous stream, other than an air stream, blasting the unmasked portions with abrasive particles in a liquid stream, such as a water stream, blasting the unmasked portions with a liquid jet, such as a water jet, or etching the unmasked portions with a chemical agent. The treating step removes all of the initial finish from the unmasked portions and causes the unmasked portion to have a roughened finish compared to the initial finish.

Next, the mask is removed, whereupon the unmasked portions or all external surfaces of the plumbing fixture may be then coated with a clear polymeric material, such as an epoxy. Ordinarily, a clear polymeric material is not needed over a plated or coated surface, which is durable in itself, or over an exposed stainless steel surface, which is durable in itself, as compared to an exposed brass surface, which is not durable unless protected, as by a clear polymeric material.

In making a first embodiment of this invention by the steps diagrammed in FIG. 1, a faucet spout is cast from brass and is deburred, cleaned, polished, and buffed, in conventional ways, whereupon the faucet spout is electroplated, in a conventional way, with a penultimate layer of a sulphur-bearing, bright nickel and with an ultimate layer of a gold alloy, which consists essentially of about 99.5% (or more) gold and about 0.5% (or less) of an alloying element selected from Group I B, II B, or VIII B, on a weight basis, so as to provide an initial finish on an expansive surface of the faucet spout. The gold alloy, which is yellow, contrasts in color with bright nickel, which is grey. The initial finish may be then buffed.

A mask, which is die-cut from hard, synthetic rubber is caused to adhere removably to selected portions of the expansive surface by means of a pressure-sensitive adhesive, leaving the expansive surface with unmasked portions where the mask does not adhere to the expansive surface, and outlining an ornamental design on the expansive surface. All other exposed surfaces of the faucet spout are masked completely by similar masks.

The unmasked portions of the expansive surface are blasted with abrasive particles in an air stream, in a blasting cabinet of a type employed conventionally to remove surface finishes, such as a Universal TM Model #36P-DC 100 blasting cabinet, so as to remove all of the ultimate layer of the gold alloy from the unmasked portions, so as to expose the penultimate layer of sulphur-bearing, bright nickel on the unmasked portions, and so as to cause the unmasked portions to have an abraded, roughened finish, thereby to cause the unmasked portions to contrast visually, both in smoothness and in color, with the initial finish when the mask is removed. Silica particles (sand) or epoxy beads are suitable particles for blasting the unmasked portions Next, the mask on the expansive surface and other masks are removed, as a final step in making the second embodiment of this invention.

In making a second embodiment of this invention by the steps diagrammed in FIG. 2, a faucet spout is cast from brass and is deburred, cleaned, polished, and buffed, in conventional ways, whereupon the fauced spout is electroplated, in a conventional way, with a layer of a sulphur-bearing, bright nickel, so as to provide an initial finish on an expansive surface of the faucet spout. The bright nickel, which is grey, contrasts in color with brass, which is yellow. The initial finish may be then buffed.

A mask, which is similar to the masks used in making the first embodiments described above, is caused to adhere removably to selected portions of the expansive surface, by means of a pressure-sensitive adhesive, leaving the expansive surface with unmasked portions where the mask does not adhere to the expansive surface, and outlining an ornamental design on the expansive surface. All other exposed surfaces of the faucet spout are masked completely by similar masks.

The unmasked portions of the expansive surface are blasted with abrasive particles in an air stream, in a blasting cabinet of the type mentioned above, so as to remove all of the layer of sulphur-bearing, bright nickel from the unmasked portions, so as to cause the unmasked portions to have an abraded, roughened finish, thereby to cause the unmasked portions to contrast visually, both in smoothness and in color, with the initial finish. Silica particles (sand) or epoxy beads are suitable particles for blasting the unmasked portions.

Next, the mask on the expansive surface and the other masks are removed, and all exposed surfaces of the faucet spout then are coated with a clear epoxy material, as final steps in making the second embodiment of this invention.

In making a third embodiment of this invention by the steps diagrammed in FIG. 3, a faucet spout is stamped from stainless steel and is deburred, cleaned, polished, and buffed, in conventional ways, whereupon outer surfaces of the faucet spout are coated, in a conventional way, with a colored, thermoset, polymeric material, such as a white epoxy applied electrostatically, as a powder, before it is thermoset, so as to provide an initial finish on an expansive surface of the faucet spout. The initial finish, as provided by the thermoset, polymeric material, tends to be quite smooth.

A mask, which is similar to the masks used in making the first and second embodiments noted above, is caused to adhere removably to selected portions of the expansive surface, by means of a pressure-sensitive adhesive, leaving the expansive surface with unmasked portions where the mask does not adhere to the expansive surface, and outlining an ornamental design on the expansive surface. All other exposed surfaces of the faucet spout are masked completely by similar masks.

The unmasked portions of the expansive surface are blasted with abrasive particles in an air stream, in a blasting cabinet of the type mentioned above, so as to remove all of the coating of polymeric material from the unmasked portions, and so as to cause the unmasked portions to have an abraded, roughened finish of exposed stainless steel, thereby to cause the unmasked portions to contrast visually, both in smoothness and in color, with the initial finish of colored polymeric material when the mask is removed. Epoxy beads are suitable particles for blasting the unmasked portions.

Next, the mask on the expansive surface and the other masks are removed, as a final step in making the third embodiment of this invention.

In making each embodiment described above, an expansive surface of the faucet spout is decorated with an ornamental design, which is defined by visually contrasting portions of the expansive surface. Such portions contrast visually in smoothness and in color. The mask caused to adhere to the expansive surface determines the ornamental design. Because the mask is caused to adhere to the expansive surface by a pressure-sensitive adhesive, not merely placed against the expansive surface, the ornamental design tends to be sharply defined.

The method provided by this invention may be variously modified without departing from the scope and spirt of this invention.

What is claimed is:

1. A method of providing a sharply defined, ornamental design on an expansive surface of a zinc, brass, or stainless steel faucet spout or other plumbing fixture, the method comprising steps of (a) providing an initial finish on the expansive surface, the initial finish contrasting in color with what is beneath the initial finish, (b) causing a mask to adhere to selected portions of the expansive surface, by means of an adhesive, leaving the expansive surface with unmasked portions where the mask does not adhere to the expansive surface, (c) treating the unmasked portions so as to remove all of the initial finish from the unmasked portions, thereby to cause the unmasked portions to contrast in color with the initial finish when the mask is removed, and (d) removing the mask, wherein the expansive surface is plated with at least two plating layers, which include a penultimate plating layer and an ultimate plating layer contrasting in color with the penultimate plating layer, and wherein step (c) is performed so as to remove all of the ultimate plating layer from the unmasked portions of the expansive surface, and so as to expose the penultimate plating layer on the unmasked portions of the expansive surface, and whereby the ornamental design is defined sharply by color-contrasted portions of the expansive surface.

2. The method of claim 1 wherein step (c) includes blasting the unmasked portions with a liquid jet so as to cause the unmasked portions to have a roughened finish compared to the initial finish.

3. The method of claim 1 wherein step (c) includes blasting the unmasked portions with abrasive particles so as to cause the unmasked portions to have a roughened finish compared to the initial finish.

4. The method of claim 1 wherein step (c) includes etching the unmasked portions so as to cause the unmasked portions to have a roughened finish compared to the initial finish.

5. The method of claim 1 wherein step (c) includes brushing the unmasked portions so as to cause the unmasked portions to have a roughened finish compared to the initial finish.

6. A method of providing a sharply defined, ornamental design on an expansive surface of a zinc, brass, or stainless steel faucet spout or other plumbing fixture, the method comprising steps of (a) providing an initial finish on the expansive surface, the initial finish contrasting in color with what is beneath the initial finish, (b) causing a mask to adhere to selected portions of the expansive surface, by means of an adhesive, leaving the expansive surface with unmasked portions where the mask does not adhere to the expansive surface, (c) treating the unmasked portions so as to remove all of the initial finish from the unmasked portions, thereby to cause the unmasked portions to contrast in color with the initial finish when the mask is removed, and (d) removing the mask, wherein step (a) includes polishing and buffing the expansive surface, and coating the expansive surface with a polymeric material, which provides the initial finish, and whereby the ornamental design is defined sharply by color-contrasted portions of the expansive surface.

7. The method of claim 6 wherein step (c) includes blasting the unmasked portions with a liquid jet so as to cause the unmasked portions to have a roughened finish compared to the initial finish.

8. The method of claim 6 wherein step (c) includes blasting the unmasked portions with abrasive particles so as to cause the unmasked portions to have a roughened finish compared to the initial finish.

9. The method of claim 6 wherein step (c) includes etching the unmasked portions so as to cause the unmasked portions to have a roughened finish compared to the initial finish.

10. The method of claim 6 wherein step (c) includes brushing the unmasked portions so as to cause the unmasked portions to have a roughened finish compared to the initial finish.

* * * * *